US011731019B2

(12) United States Patent
Greiner et al.

(10) Patent No.: US 11,731,019 B2
(45) Date of Patent: Aug. 22, 2023

(54) BALL AND HOOP GAME

(71) Applicant: SANDS END SPORTS, LLC, Blue Point, NY (US)

(72) Inventors: Gregory C. Greiner, Forest Hills, NY (US); Kyle M. Greiner, Roswell, GA (US)

(73) Assignee: Sans End Sports LLC, Blue Point, NY (US)

( * ) Notice: Subject to any disclaimer, the term of this patent is extended or adjusted under 35 U.S.C. 154(b) by 0 days.

(21) Appl. No.: 17/702,569

(22) Filed: Mar. 23, 2022

(65) Prior Publication Data

US 2022/0362645 A1 Nov. 17, 2022

Related U.S. Application Data

(63) Continuation of application No. 16/170,990, filed on Oct. 25, 2018, now abandoned.

(60) Provisional application No. 62/576,737, filed on Oct. 25, 2017.

(51) Int. Cl.

| | |
|---|---|
| ***A63B 63/08*** | (2006.01) |
| ***A63B 71/02*** | (2006.01) |
| ***A63B 71/00*** | (2006.01) |

(52) U.S. Cl.

CPC ..... *A63B 63/08* (2013.01); *A63B 71/0036* (2013.01); *A63B 71/023* (2013.01); *A63B 2210/50* (2013.01); *A63B 2225/093* (2013.01)

(58) Field of Classification Search

CPC ... A63B 63/08; A63B 71/0036; A63B 71/023; A63B 2210/50; A63B 2225/093

See application file for complete search history.

(56) References Cited

U.S. PATENT DOCUMENTS

| | | | | | |
|---|---|---|---|---|---|
| 214,061 | A | * | 4/1879 | Stearns | A47G 7/047 47/41.01 |
| 1,211,379 | A | * | 1/1917 | Maisch | A63F 9/02 273/400 |
| 1,544,453 | A | * | 6/1925 | Harbison | A63B 63/083 273/127 R |

(Continued)

FOREIGN PATENT DOCUMENTS

| | | | | |
|---|---|---|---|---|
| CN | 2868353 | Y | * 2/2007 | |
| CN | 203253128 | U | * 10/2013 | |
| GB | 2581169 | A | * 8/2020 | A63B 63/004 |

*Primary Examiner* — William M Pierce
(74) *Attorney, Agent, or Firm* — Culhane Meadows PLLC; Aasheesh V. Shravah

(57) ABSTRACT

Exemplary embodiments of a game apparatus and a method of playing the game are provided. In some exemplary embodiments, a method of playing a game is provided, comprising providing a first pole having a first hoop and a second hoop, providing a second pole having a first hoop and a second hoop, selecting a first team having a first player adjacent the first pole and a second player adjacent the second pole, selecting a second team having a first player adjacent the first pole and a second player adjacent the second pole, wherein the first player serves the ball directly to the second player of the first team, and providing a method of scoring wherein points are awarded to the first team if the second player puts the ball in the first hoop, second hoop or both the first hoop and the second hoop of the second pole.

20 Claims, 16 Drawing Sheets

(56) References Cited

U.S. PATENT DOCUMENTS 1,747,951 A * 2/1930 Reichert ..... A47F 7/06 211/33
1,797,077 A * 3/1931 John ..... A47G 7/041 248/315
3,018,898 A * 1/1962 Frazelle ..... F16M 11/046 248/220.43
3,362,712 A * 1/1968 Wagner ..... A63F 7/06 273/374
3,628,793 A * 12/1971 Mudloff ..... A63B 67/06 473/594
3,643,950 A * 2/1972 Hoik ..... A63F 9/0204 273/394
3,716,234 A * 2/1973 Lancellotti ..... A63B 63/083 248/346.03
D244,571 S * 6/1977 Cowan, Jr. ..... D6/405
4,266,763 A * 5/1981 Collins ..... A63B 63/083 473/481
4,268,029 A * 5/1981 Collins ..... A63C 19/00 473/481
4,842,134 A * 6/1989 Chang ..... A45C 13/02 206/579
D307,616 S * 5/1990 Kelly ..... D21/702
4,936,577 A * 6/1990 Kington ..... A63B 69/0071 473/433
4,936,590 A * 6/1990 Palmer ..... A63B 63/08 273/DIG. 30
4,961,586 A * 10/1990 Conville ..... A63F 9/02 273/402
5,056,796 A * 10/1991 Conville ..... A63B 67/06 273/402
5,069,441 A * 12/1991 Fang ..... A63B 63/083 473/485
5,096,191 A * 3/1992 Fang ..... A63B 63/083 273/400
5,125,651 A * 6/1992 Keeling ..... A63B 63/083 473/448
5,201,527 A * 4/1993 Koket ..... A63B 71/0036 273/402
5,224,699 A * 7/1993 Zaruba ..... A63B 63/083 273/375
5,248,140 A * 9/1993 Mower ..... A63B 63/083 473/484
5,290,040 A * 3/1994 Boroski ..... A63B 67/06 273/DIG. 30
D345,871 S * 4/1994 Anderson ..... D6/680.2
5,354,049 A * 10/1994 Matherne ..... A63B 71/023 473/484
5,377,976 A * 1/1995 Matherne ..... A63B 63/083 473/483
5,415,393 A * 5/1995 Fitzsimmons ..... A63B 71/023 248/528
5,450,692 A * 9/1995 Ruibal ..... A01G 9/023 D11/143
5,681,043 A * 10/1997 Winblad ..... A63B 65/12 124/64
5,681,230 A * 10/1997 Krings ..... A63B 69/0071 473/433
5,730,668 A * 3/1998 Hege ..... A63B 71/023 206/427
5,827,136 A * 10/1998 Halter ..... A63B 63/083 473/448
5,842,699 A * 12/1998 Mirando ..... A63B 69/0071 473/480
D403,533 S * 1/1999 Paul ..... D6/677.3
5,881,537 A * 3/1999 Schickert ..... F16M 11/2021 53/445
5,954,337 A * 9/1999 Cunningham ..... A63B 67/06 273/338
D435,177 S * 12/2000 Buell ..... D6/403
6,299,556 B1 * 10/2001 Redden ..... A63B 63/08 473/483
6,299,570 B1 * 10/2001 Lim ..... A63B 21/4035 482/148
6,312,349 B1 * 11/2001 Roberts ..... A63B 63/083 473/448
6,338,686 B1 * 1/2002 King ..... A63B 71/0669 473/415
D466,763 S * 12/2002 Wu ..... D7/637
6,595,377 B1 * 7/2003 Hetu ..... A47F 7/0078 211/208
6,780,129 B1 * 8/2004 Higuchi ..... A63B 63/08 273/390
6,843,478 B1 * 1/2005 Hoepelman ..... A63B 63/06 273/342
6,958,022 B2 * 10/2005 O'Neill ..... A63B 63/083 473/481
7,407,453 B2 * 8/2008 Shannon ..... A63B 63/083 473/483
7,740,550 B1 * 6/2010 Kaufman ..... A63B 69/385 473/459
D681,380 S * 5/2013 Lien ..... D6/552
8,475,301 B1 * 7/2013 Lane ..... A63B 71/0036 473/492
8,651,492 B1 * 2/2014 Cappuccio ..... A63B 71/0036 273/398
9,017,188 B2 * 4/2015 Joseph ..... G01S 13/66
D736,321 S * 8/2015 Shadle ..... D21/302
9,199,149 B2 * 12/2015 Max ..... A63B 63/08
D809,818 S * 2/2018 Houting ..... D6/405
9,943,737 B1 * 4/2018 Burdan ..... A63H 33/18
10,603,559 B1 * 3/2020 Farley ..... A63B 69/0071
11,207,580 B1 * 12/2021 Mynatt ..... A63B 67/002
2003/0190981 A1 * 10/2003 Walker, Jr. ..... A63B 69/0071 473/472
2005/0082244 A1 * 4/2005 Ho ..... A47G 7/041 211/196
2005/0113192 A1 * 5/2005 Seaman ..... A63B 63/083 473/450
2005/0134001 A1 * 6/2005 Rowan ..... A63B 63/004 273/401
2007/0287560 A1 * 12/2007 Stanford ..... A63B 63/083 473/481
2008/0157476 A1 * 7/2008 Striebel ..... A63B 63/00 273/402
2008/0252018 A1 * 10/2008 Chung ..... A63B 24/0021 273/402
2010/0210379 A1 * 8/2010 Shelley ..... A63B 69/0071 473/433
2010/0261559 A1 * 10/2010 Kaufman ..... A63B 69/385 473/459
2010/0267496 A1 * 10/2010 Johnson ..... A63B 71/023 473/447
2011/0237362 A1 * 9/2011 Yach ..... A63B 63/08 473/481
2012/0169012 A1 * 7/2012 Parker ..... A63B 67/002 273/400
2012/0240458 A1 * 9/2012 Ganske ..... A01G 9/00 137/561 A
2013/0157786 A1 * 6/2013 Joseph ..... A63B 24/0075 473/436
2013/0200246 A1 * 8/2013 VanBenschoten .... B60B 33/063 248/519
2014/0265138 A1 * 9/2014 Esposito ..... A63B 67/06 273/400
2014/0274489 A1 * 9/2014 Kurt ..... A63B 71/02 473/472
2015/0301715 A1 * 10/2015 Schlossberg ..... A63F 13/235 463/31
2015/0328515 A1 * 11/2015 Prendergast ..... A63B 43/00 273/400
2016/0263457 A1 * 9/2016 Campbell ..... A63B 71/0616
2016/0325167 A1 * 11/2016 Constantin ..... A63B 69/0071
2016/0325168 A1 * 11/2016 Campbell ..... A63B 69/408
2017/0232298 A1 * 8/2017 Joseph ..... A63B 69/40 473/433

(56) References Cited

U.S. PATENT DOCUMENTS

| | | | | |
|---|---|---|---|---|
| 2019/0118055 | A1* | 4/2019 | Greiner | A63B 71/0036 |
| 2019/0224545 | A1* | 7/2019 | Torgerson | A63B 63/007 |
| 2021/0260455 | A1* | 8/2021 | Samp | A63B 63/08 |

* cited by examiner

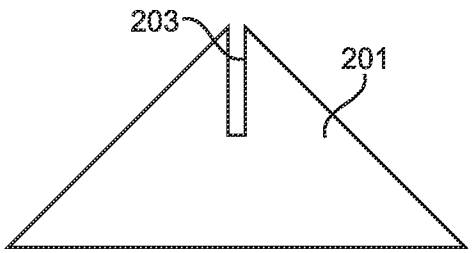
FIG. 3A
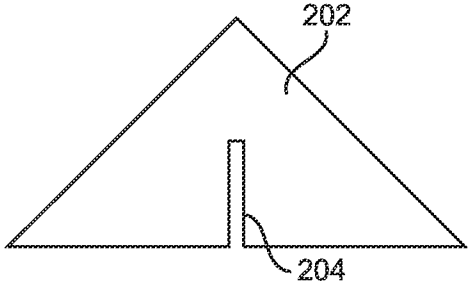
FIG. 3B
FIG. 3C
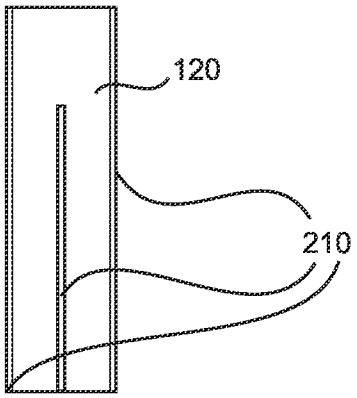
FIG. 3D
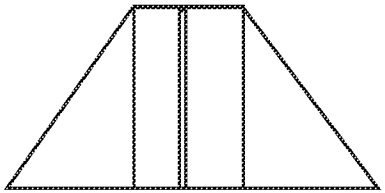
FIG. 3E

*KEY*

TEAM A: PLAYER 1A, PLAYER 2A
TEAM B: PLAYER 1B, PLAYER 2B

BASKETBALL HOOPS UNIT: SMALL (HIGH) HOOP;LARGE (LOW) HOOP; POLES(S); BASE

**PLAYERS MAY NOT HIT BALL CONSECUTIVELY

BALL AND HOOP GAME

CROSS-REFERENCE TO RELATED APPLICATIONS

This application is a continuation of U.S. application Ser. No. 16/170,990 filed on Oct. 25, 2018, which relates to and claims priority from U.S. Provisional Patent Application Ser. No. 62/576,737 filed Oct. 25, 2017, the entire disclosures of which are hereby incorporated herein by reference.

FIELD OF THE DISCLOSURE

The present disclosure relates to exemplary embodiments of a ball and hoop game, and more particularly, to an apparatus and method of playing a ball game using one or more hoops.

BACKGROUND INFORMATION

Various ball games exist with variations of putting a ball through a hoop. Some of these solutions attempt to customize basketball hoops, goals, backboards, nets and balls. It would be desirable to provide a portable apparatus providing a ball game using one or more hoops, and a novel method of playing the game, as described below.

SUMMARY OF EXEMPLARY EMBODIMENTS OF THE DISCLOSURE

At least some of the above described problems can be addressed by exemplary embodiments of the present disclosure. Exemplary embodiments of the present disclosure can provide for a portable apparatus having two hoops on a pole where one hoop is vertically positioned above the other, and a method of playing a game using the apparatus.

In some exemplary embodiments, a method of playing a game is provided, comprising providing a first portable apparatus at a first location, the first portable apparatus comprising a first pole extending vertically from a base portion and having an upper hoop and a lower hoop connected to the first pole, the lower hoop being provided under the upper hoop, providing a second portable apparatus at a second location opposite the first location, the second portable apparatus comprising a second pole extending vertically from a base portion and having an upper hoop and a lower hoop connected to the second pole, the lower hoop being provided under the upper hoop, selecting a first team and a second team, each team having a first player adjacent the first portable apparatus and a second player adjacent the second portable apparatus, wherein a first player of the first team adjacent the first portable apparatus stands behind the base portion of the first portable apparatus and serves a ball to the second player of the first team adjacent the second portable apparatus, wherein the second player of the first team receives the ball and can (i) score the ball through the lower hoop of the second portable apparatus for a set number of points (ii) score the ball through the upper hoop of the second portable apparatus for a set number of points greater than the set number of points of (i), and (iii) score the ball through the upper hoop and lower hoop of the second portable apparatus for a set number of points greater than (ii); or (iv) hit the ball back to the first player of the first team.

In some exemplary embodiments, the upper hoops and the lower hoops of the first and second poles are circular hoops, and the upper hoops have a smaller diameter than the lower hoops. In some exemplary embodiments, the lower hoops of the first and second poles are horizontally offset from the upper hoops of the first and second poles, respectively, and an outermost portion of the lower hoops extends further from the first and second poles than an outermost portion of the upper hoops of the first and second poles, respectively. In some exemplary embodiments, the upper hoops of the first and second poles have a diameter of approximately 8 inches to approximately 16 inches, and the lower hoops of the first and second poles have a diameter of approximately 10 inches to approximately 20 inches. In some exemplary embodiments, the upper hoops and the lower hoops are adjustable along a height of the first pole and the second pole. In some exemplary embodiments, the lower hoops are provided approximately two feet under the upper hoops of the first and second poles.

In some exemplary embodiments, the method further comprises awarding a set number of points if the second player of the first team hits the ball back to the first player of the first team and the first player of the first team scores the ball through the upper hoop or lower hoop of the second portable apparatus. In some exemplary embodiments, the first player or second player of the first team may not directly contact the upper or lower hoops of the second portable apparatus. In some exemplary embodiments, a set number of points are deducted from the first team if the first player or second player of the first team makes direct contact with the upper hoop or lower hoop of the second portable apparatus. In some exemplary embodiments, the first portable apparatus is provided approximately 20 to approximately 30 feet away from the second portable apparatus. In some exemplary embodiments, when the first player of the first team serves the ball to the second player of the first team, the ball must be served directly to the second player of the first team without making contact with the ground or any other object, or the first team loses possession and the ball is given to the second team.

In some exemplary embodiments, a method of playing a game is provided, comprising providing a first pole having a first hoop and a second hoop under the first hoop on the first pole, providing a second pole opposite the first pole, the second pole having a first hoop and a second hoop under the first hoop on the second pole, selecting a first team having a first player adjacent the first pole and a second player adjacent the second pole, selecting a second team having a first player adjacent the first pole and a second player adjacent the second pole, wherein the first player of the first team stands behind the first pole and serves the ball directly to the second player of the first team adjacent the second pole, providing a method of scoring wherein (i) awarding one or more points to the first team if the second player scores the ball in the second hoop of the second pole, (ii) awarding two or more points to the first team if the second player scores the ball in the first hoop of the second pole, and (iii) awarding three or more points to the first team if the second player scores the ball in the first hoop and the second hoop of the second pole.

In some exemplary embodiments, the method further comprises providing a method of scoring when the first player of the first team serves the ball directly to the second player of the first team, the second player of the first team hits the ball back to the first player of the first team, wherein (i) awarding one or more points to the first team if the first player scores the ball in the second hoop of the second pole, (ii) awarding two or more points to the first team if the first player scores the ball in the first hoop of the second pole, and (iii) awarding three or more points to the first team if the first player scores the ball in the first hoop and the second hoop of the second pole.

In some exemplary embodiments, the first player or second player of the first team may not directly contact the first hoop or second hoop of the second pole. In some exemplary embodiments, a point is deducted from the first team if the first player or second player of the first team makes direct contact with the first hoop or second hoop of the second pole and the ball is given to the second team for their turn. In some exemplary embodiments, the method further comprises, when the second team gets the ball the second player of the second team stands behind the second pole and serves the ball directly to the first player of the second team adjacent the first pole, providing a method of scoring wherein (i) awarding one or more points to the second team if the first player of the second team scores the ball in the second hoop of the first pole, (ii) awarding two or more points to the second team if the first player of the second team scores the ball in the first hoop of the first pole, and (iii) awarding three or more points to the second team if the first player of the second team scores the ball in the first hoop and the second hoop of the first pole.

In some exemplary embodiments, the method further comprises providing a method of scoring when the second player of the second team serves the ball directly to the first player of the second team, the first player of the second team hits the ball back to the second player of the second team, wherein (i) awarding one or more points to the second team if the second player of the second team scores the ball in the second hoop of the first pole, (ii) awarding two or more points to the second team if the second player of the second team scores the ball in the first hoop of the first pole, and (iii) awarding three or more points to the second team if the second player of the second team scores the ball in the first hoop and the second hoop of the first pole.

In some exemplary embodiments, the first pole is provided approximately 20 to approximately 30 feet away from the second pole. In some exemplary embodiments, the first hoops and the second hoops of the first and second poles are circular hoops, and the first hoops have a smaller diameter than the second hoops. In some exemplary embodiments, the second hoops of the first and second poles are horizontally offset from the first hoops of the first and second poles, respectively, and an outermost portion of the second hoops extends further from the first and second poles than an outermost portion of the first hoops of the first and second poles, respectively.

BRIEF DESCRIPTION OF THE DRAWINGS

The foregoing and other objects of the present disclosure will be apparent upon consideration of the following detailed description, taken in conjunction with the accompanying drawings and claims, in which like reference characters refer to like parts throughout, and in which:

FIGS. 3*a*-3*e* illustrates an alternative embodiment of a base according to the exemplary embodiments of the present disclosure;

Figure 1A:
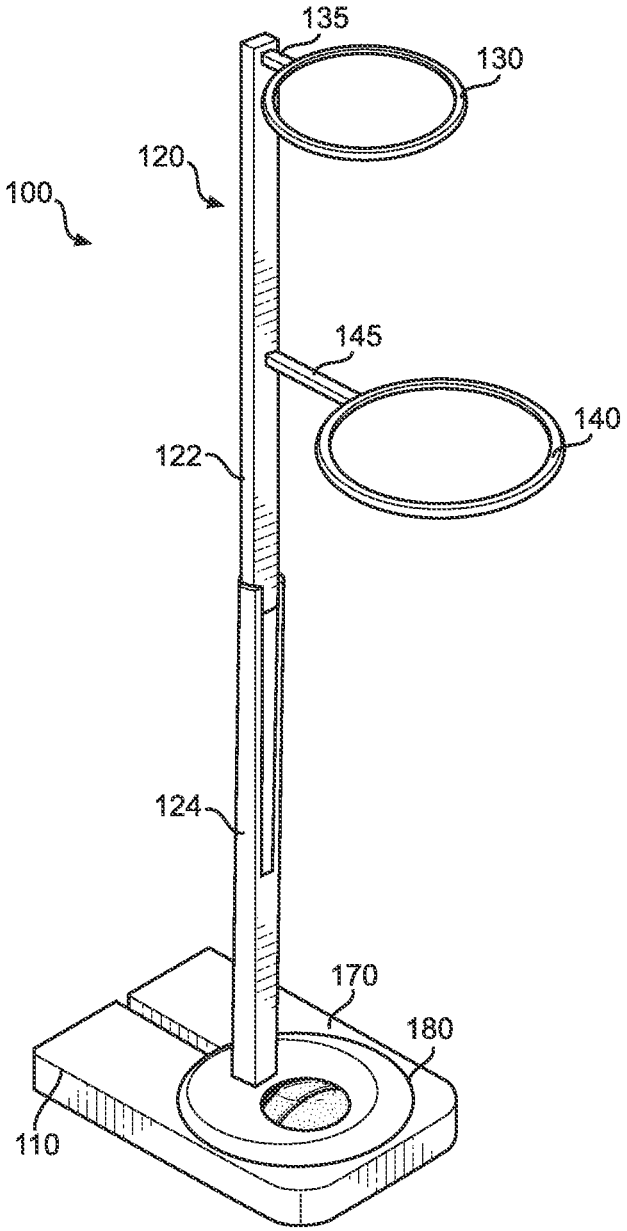
FIGS. 1*a*-1*b* illustrates an apparatus according to the exemplary embodiments of the present disclosure.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative embodiments. It is intended that changes and modifications can be made to the described embodiments without departing from the true scope and spirit of the subject disclosure.

DETAILED DESCRIPTION OF EXEMPLARY EMBODIMENTS OF DISCLOSURE

Exemplary embodiments of the methods and systems will now be described with reference to the figures. The following description of the various embodiments is merely exemplary in nature and is in no way intended to limit the scope of the disclosure, its application, or uses.

Figure 1B:
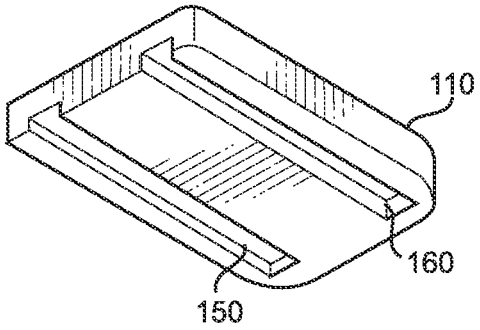

FIGS. 1*a*-1*b* illustrates an apparatus according to the exemplary embodiments of the present disclosure. As shown in FIG. 1*a*, an apparatus 100 is provided comprising a base 110 and a vertical pole 120 that is positioned inside a receptacle in the base configured to hold the pole 120 sturdy. In some exemplary embodiments, a clamp or lock can be provided to secure the pole 120 within the base 110. The base 110 can be made of any material, such as metal or plastic or a composite of materials, and is not limited to any type of material. In some exemplary embodiments, the base 110 can be hollow and can be filled with water and/or sand through a receptacle (not shown) which can make the base 110 sturdier when in use. The base 110 can be made of materials or configured to make it sturdy without the use of water or sand. The pole 120 can also be made of any material, and be similar to the material of the base 110. In some exemplary embodiments, the pole 120 can comprise two or more poles, such as upper pole 122 and lower pole 124. Upper pole 122 can slide within lower pole 124, making the height of the pole 120 adjustable, such as but not limited to between 4 feet to 12 feet. A clamp or locking pin can be provided to position the upper pole 122 and lower pole 124, which can have slots that align with each other during placement of the locking pin. The slots can be provided, e.g., every two to six inches for adjustability of the height of the pole 120.

One or more hoops can be provided on the vertical pole 120. In some exemplary embodiments, an upper hoop 130 is provided at or near the top of the upper pole 122, and a lower hoop 140 is provided underneath the upper hoop 130. In some exemplary embodiments, the lower hoop 140 can be connected to the upper pole 122, or the lower pole 124. Slots can be provided at regular intervals throughout the height of the pole 120 on the upper pole 122 and lower pole 124 to provide for adjustability of the locations of the upper hoop 130 and lower hoop 140. In some exemplary embodiments, more than two hoops can be provided on the pole 120. An upper bracket 135 can be provided to connect the upper hoop 130 to the pole 120 and a lower bracket 145 can be provided to connect the lower hoop 140 to the pole 120. The upper bracket 135 and lower bracket 145 can be inserted within desired slots in the pole 120 as desired. In some exemplary embodiments, the upper bracket 135 can have a shorter length than the lower bracket 145, so that the lower hoop 140 is horizontally offset from the upper hoop 130 with respect to the pole 120, as will be described below.

The upper hoop 130 and lower hoop 140 can have any shape or configuration, such as circular, square, rectangular of any other shape. Preferably, the upper and lower hoops are circular. The upper hoop 130 and lower hoop 140 can be the same size or one can be larger than the other. In some exemplary embodiments, the upper hoop 130 has a smaller diameter than the lower hoop 140. In some exemplary embodiments, the diameter of the upper hoop 130 can be between 8 inches to 16 inches, and the diameter of the lower hoop can be between 10 inches to 20 inches. Preferably, the upper hoop 130 can have an approximately 12 inch diameter and the lower hoop 140 can have an approximately 15 inch diameter. The upper hoop 130 and lower hoop 140 can be made of any material, such as plastic or metal. The upper hoop 130 and lower hoop 140 can also have nets similar to a basketball hoop, as will be described below.

In some exemplary embodiments, the height of the pole 120 can be at approximately 7 feet to approximately 12 feet from the bottom of the base 110. The upper hoop 130 can be approximately 5 feet to approximately 12 feet from the bottom of the base 110, and the lower hoop 140 can be approximately 3 feet to approximately 8 feet from the bottom of the base 110. The lower hoop 140 can be approximately 1 foot to approximately 3 feet under the upper hoop 130. In some exemplary embodiments, the upper hoop 130 can be positioned at the apex or crown of the pole 120 at approximately 8 feet height from the bottom of the base 110. The lower hoop 140 can be positioned approximately 2 feet below the upper hoop 130 at approximately 6 feet high from the bottom of the base 110.

In some exemplary embodiments, the apparatus can be made lightweight and portable. For example, the pole 120 can be broken down into upper pole 122 and lower pole 124. As shown in FIG. 1*b*, the base 110 can have slot 150 to snugly fit lower pole 124 and slot 160 to snugly fit upper pole 122. The top of the base 110 can have recess 170 to snugly fit upper hoop 130 (and bracket 135) and recess 180 to snugly fit lower hoop 140 (and bracket 145). Straps can be provided on the base for, e.g., a user to carry on his back or to hold. This can allow for portability of the apparatus 100 as needed.

Figure 2:
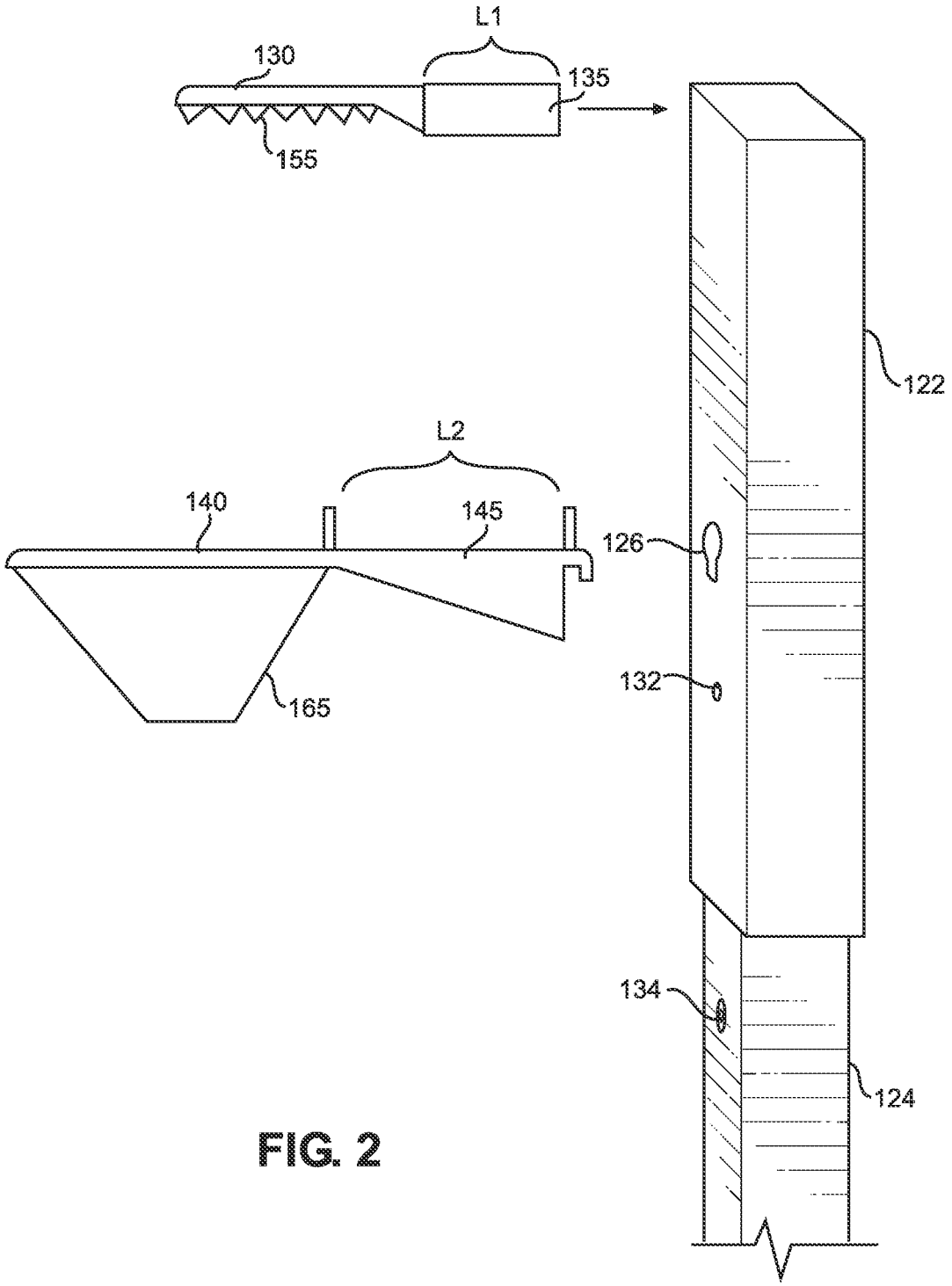
FIG. 2 illustrates a side view of an upper hoop and a lower hoop with respect to a pole according to the exemplary embodiments of the present disclosure.

FIG. 2 illustrates a side view of the upper hoop and lower hoop with respect to the pole according to the exemplary embodiments of the present disclosure. As shown, the upper hoop 130 and lower hoop can both be positioned within the upper pole 122. Slots 134 can be provided within the lower pole 124 and within the upper pole 122 to adjust the upper pole 122 on the lower pole 124, and a clip 126 can be provided to secure the upper and lower poles to each other. The upper hoop 130 can be secured to the upper pole 122 using a bracket 135. In some exemplary embodiments, the bracket 135 can be a cap that can be configured to be placed over upper pole 122. A locking mechanism (such as a clip or clamp) can be provided to further secure the upper hoop 130 to the upper pole 122. The bracket 145 can be secured to the upper pole 122 to secure the lower hoop 140 to the upper pole 122. The bracket 145 can have a clip that can be positioned within a slot 132 of the upper pole 122 to secure the lower hoop 140 to the upper pole 122. The brackets 135, 145 can be integral with the upper and lower hoops, such that the hoops can be secured directly to the pole 120. The brackets and/or upper and lower hoops can be secured to the pole 120 through any means, such as by clamps, covers, clips, locking mechanisms, sliding mechanisms, and are not limited to any particular securing or locking device.

The bracket 135 can have a length L1, which can range from approximately 2 inches to approximately 6 inches, and the bracket 145 can have a length L2 which can range from approximately 6 inches to 12 inches, but the lengths of the brackets are not limited to any particular measurement. In some exemplary embodiments, the length L1 can be approximately 4 inches and the length L2 can be approximately 8 inches, such that the lower hoop 140 is horizontally offset from the upper hoop 130 with respect to the upper pole 122, while still vertically partially overlapping the upper hoop 130. This can allow for a ball to both go through the upper hoop 130 and the lower hoop 140, as will be described below. In some exemplary embodiments, the upper hoop 130 can have a net 155 attached to the bottom of the upper hoop 135, and the lower hoop 140 can have a net 165 attached to the bottom of the lower hoop 140. In some exemplary embodiments, the net 155 can have a shorter length (e.g., approximately 2 to approximately 4 inches in length), and the net 165 can have a longer length (e.g., approximately 4 to approximately 8 inches in length). This can allow for a ball to not get trapped inside the net 155 or change its motion direction once it travels inside the upper hoop 130, as will be described below.

FIGS. 3*a*-3*e* illustrates an alternative embodiment of a base. In some exemplary embodiments, the base can be comprised of a triangle leg 201 as shown in FIG. 3(*a*) and triangle leg 202 as shown in FIG. 3(*b*). The triangle leg 201 can have an upper cutout or recess 203 and the triangle leg 201 can have a lower cutout or recess 204 as shown in FIGS. 3*a*-3*e*. The triangle leg 202 can be placed over the triangle leg 201 in a perpendicular fashion to form a base 200 with four legs as shown in FIG. 3(*c*). As shown in FIG. 3(*d*), the vertical pole 120 can have recesses 210 that have a height approximately the same height as the highest portion of the base 200. In some exemplary embodiments, there can be 4 recesses 210 that can be approximately 90 degrees apart, such that the pole 120 can fit over the triangle legs 201 and 201 as shown in FIG. 3(*e*). This can provide for a lightweight portable base according to the exemplary embodiments of the present disclosure.

Figure 4:
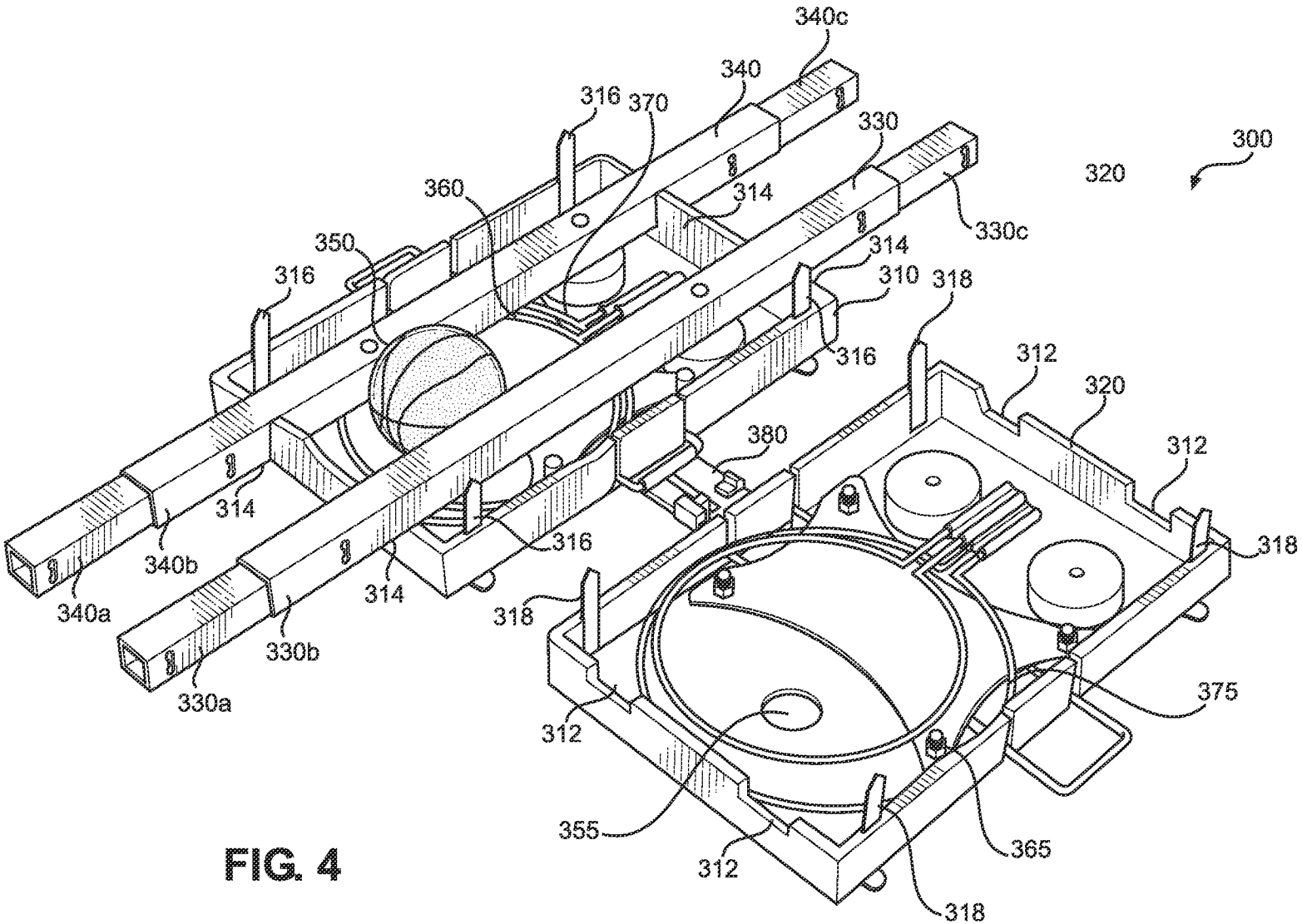
FIGS. 4-7 illustrate a portable apparatus according to the exemplary embodiments of the present disclosure.

FIG. 4 illustrates a portable apparatus according to exemplary embodiments of the present disclosure. The portable apparatus 300 can be configured to provide two ball and hoop games (as shown in FIG. 1(*a*)) that are placed on opposite sides to enable play, as will be described below. The portable apparatus 300 includes a base comprising a lower base portion 310 and an upper base portion 320. Each base portion 310, 320 can be used as a base for a ball and hoop games, as described below. The base portions 310, 320 are configured to fit the components described above to fit two ball and hoop games to make a portable game apparatus.

The upper base 320 can have slots 312 and the lower base portion 310 can have slots 314 that are configured to receive the pole 330 and the pole 340. Each pole 330, 340 is configured to have an upper and lower pole that slide out to make a pole to allow two hoops to be attached, as described below. For example, pole 330 can comprise a base 330*a*, a lower pole 330*b* and an upper pole 330*c*. The pole 340 can comprise a base 340*a*, a lower pole 340*b* and an upper pole 340*c*. The lower base portion 310 can have a recess underneath a ball 350 configured to receive and hold the ball 350. Upper hoop 360 and lower hoop 370 can be provided within the lower base portion 310. The side walls of the lower base portion 310 can have slots to receive the lower hoop 370 to secure the lower hoop 370. The pole 340 and the pole 330 can be placed on top of the upper hoop 360 and the lower hoop 370 as shown to further secure the lower hoop 370 and the upper hoop 360. The pole 340 and the pole 330 are placed within the slots 314 of the lower base portion 310. The upper base portion 320 can have a second set of hoops comprised of upper hoop 365 and lower hoop 375 that can correspond to the same size as the upper hoop 360 and lower hoop 370. The upper hoop 365 and lower hoop 375 can be secured within the upper base portion 320.

The lower base portion 310 can have legs 316 at approximately the four corners of the lower base portion 310, and the upper base portion 320 can have legs 318 at approximately the four corners of the upper base portion 320. These can allow the upper and lower base portions to stand independently when flipped over, and also when closed on top of each other (as explained below), can fit within corresponding recesses within the upper and lower base portions to secure the upper and lower base portions to each other. In some exemplary embodiments, the legs 316 and 318 can be stakes to clamp the base portions into the ground. In some exemplary embodiments, the legs 316, 318 are not needed and the flat portions of the top of the lower base portion 310 and upper base portion 320 can provide stability when placed on the ground.

Figure 5:
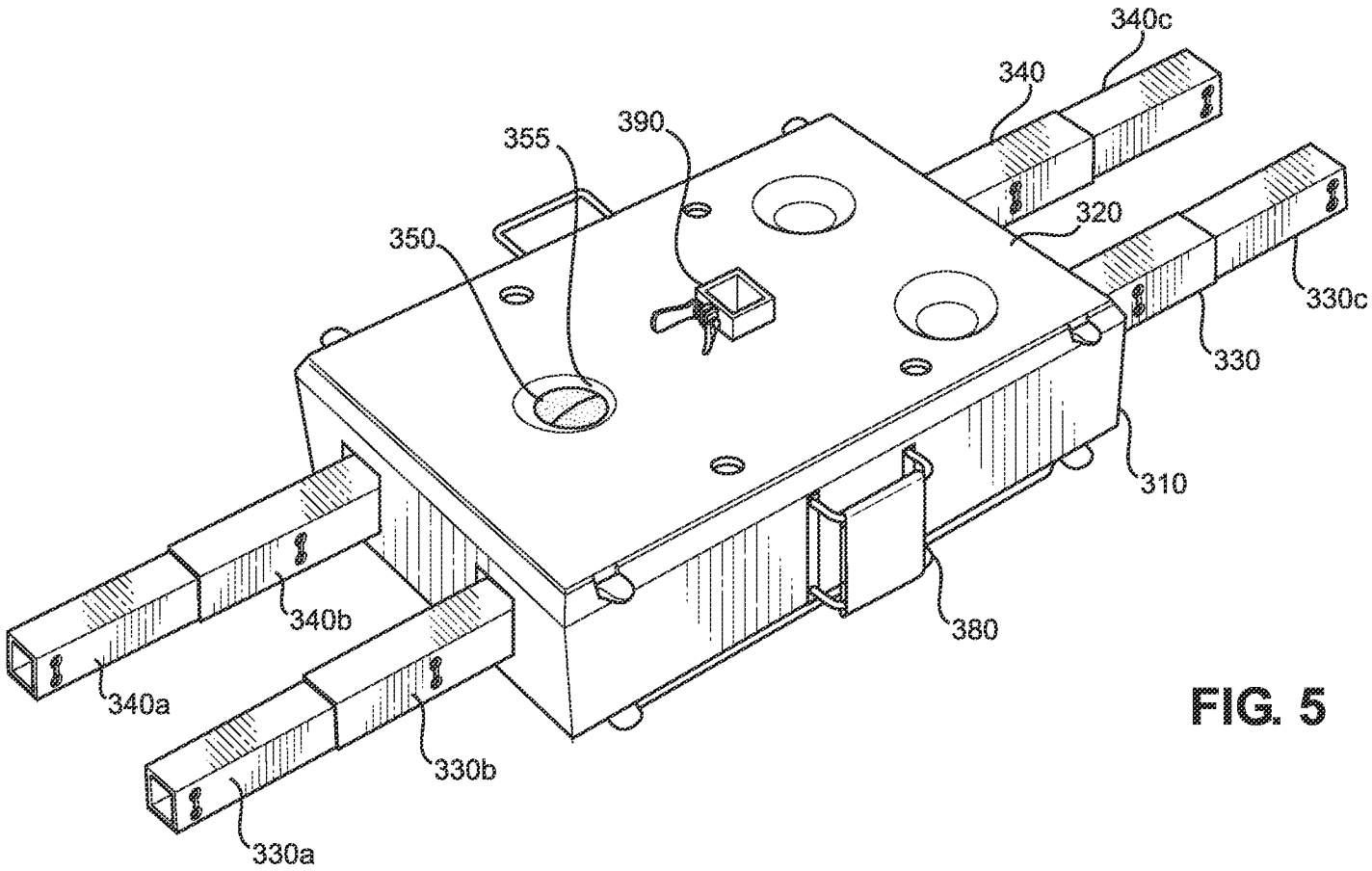

A clamp 380 can be further provided to secure and engage the upper and lower base portions to each other. The upper base portion 320 can have a recess 355 to allow for visibility of the ball 350. Once the components are secured in place, the upper base portion 320 can be placed over the lower base portion as shown in FIG. 5. The top of the upper base portion 320 allows for visibility of the ball 350 within recess 355. A pedestal 390 can also be provided for engagement and securing of the lower pole 340 within the pedestal 390 as shown in FIG. 5. In some exemplary embodiments, the pedestal 390 can be made flush with a top surface of the upper base portion 320.

Figure 6:
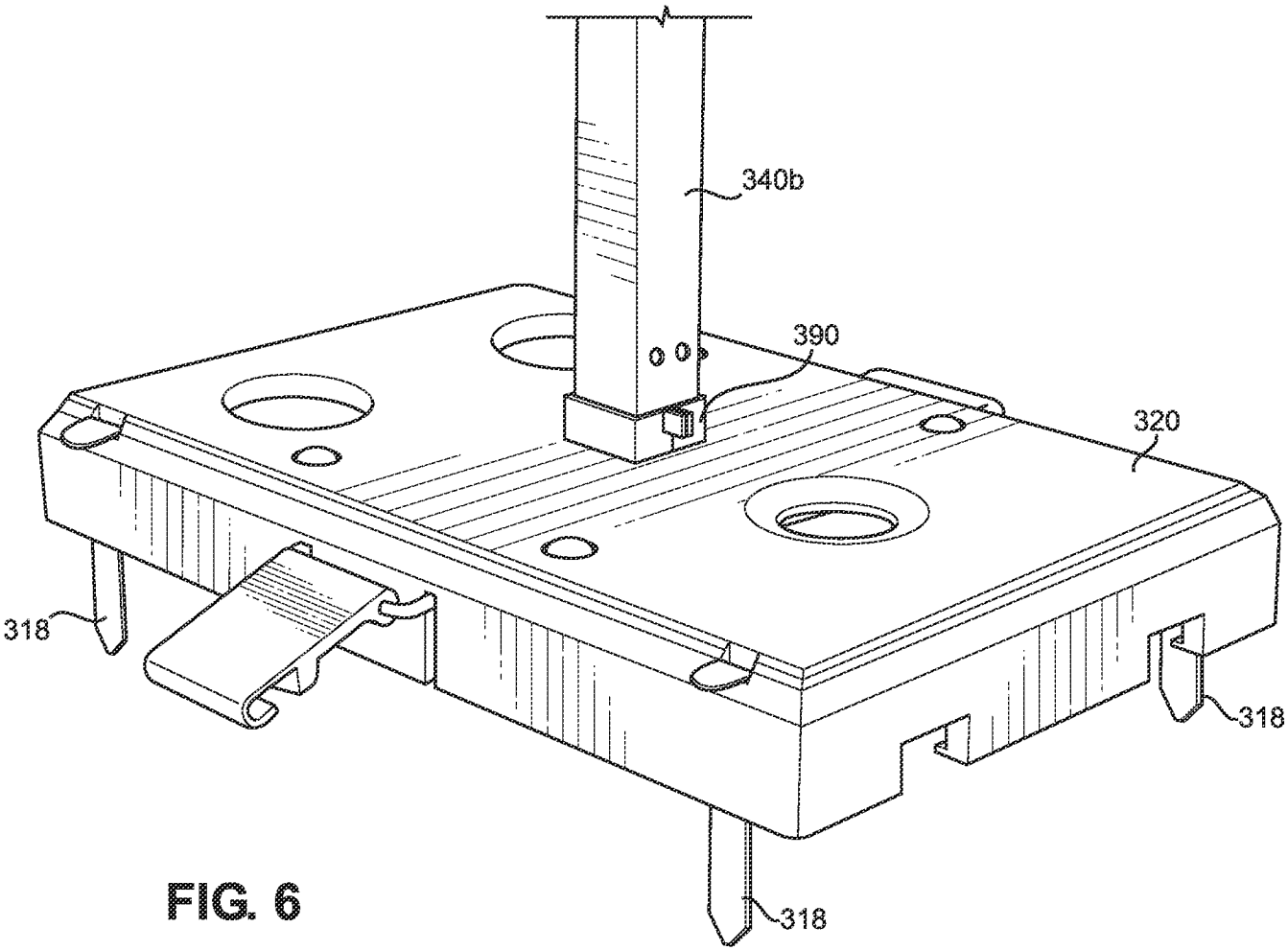

As shown in FIG. 6, the upper base portion 320 can stand on a floor using legs 318. The pole 340 can be secured within the pedestal 390 such that the base portion 340*a* is inserted inside the pedestal 390 and lower pole 340*b* is visible above the upper base portion 320. In some exemplary embodiments, a bottom of the upper base portion 320 can be flat (and the lower base portion 310) and lay on the ground for stability so the poles can be secured onto the base portions and enable game play, as will be described below.

Figure 7:
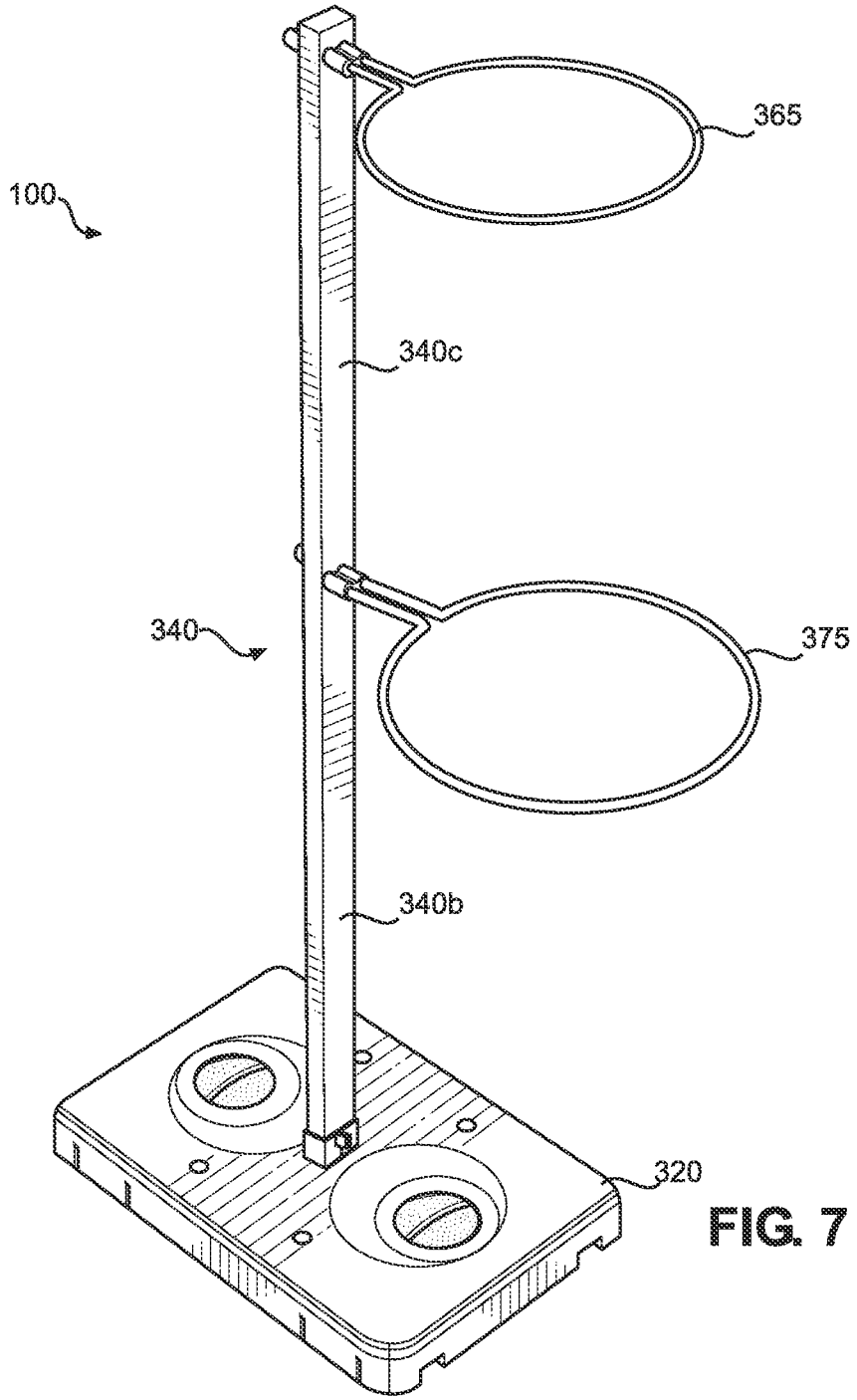

As shown in FIG. 7, the pole 340 can be secured into the upper base portion 320. The upper pole 340*c* can slide out of lower pole 340*b* and a lock can be inserted to secure the upper pole 340*c* with respect to the lower pole 340*c*. The upper hoop 365 and the lower hoop 375 can be secured to the pole 340. In the exemplary embodiment shown in FIG. 7, the upper hoop 365 is secured to the upper pole 340*c* and the lower hoop 375 is secure to the lower pole 340*b*. The lower base portion 310 can be configured similar to the upper base portion 320. That is, pole 330 can be provided within a pedestal 390, and the upper pole 330*c* can be extended and secured with respect to the lower pole 330*b*, and upper hoop 360 can be provided on upper pole 330*c* and lower hoop 370 can be provided on lower pole 330*b*. The upper base portion 320 with the pole 340 and the hoops, and the lower base portion 310 with the pole 340 and the hoops, can be used to face each other and play a game as described below.

Figure 8:
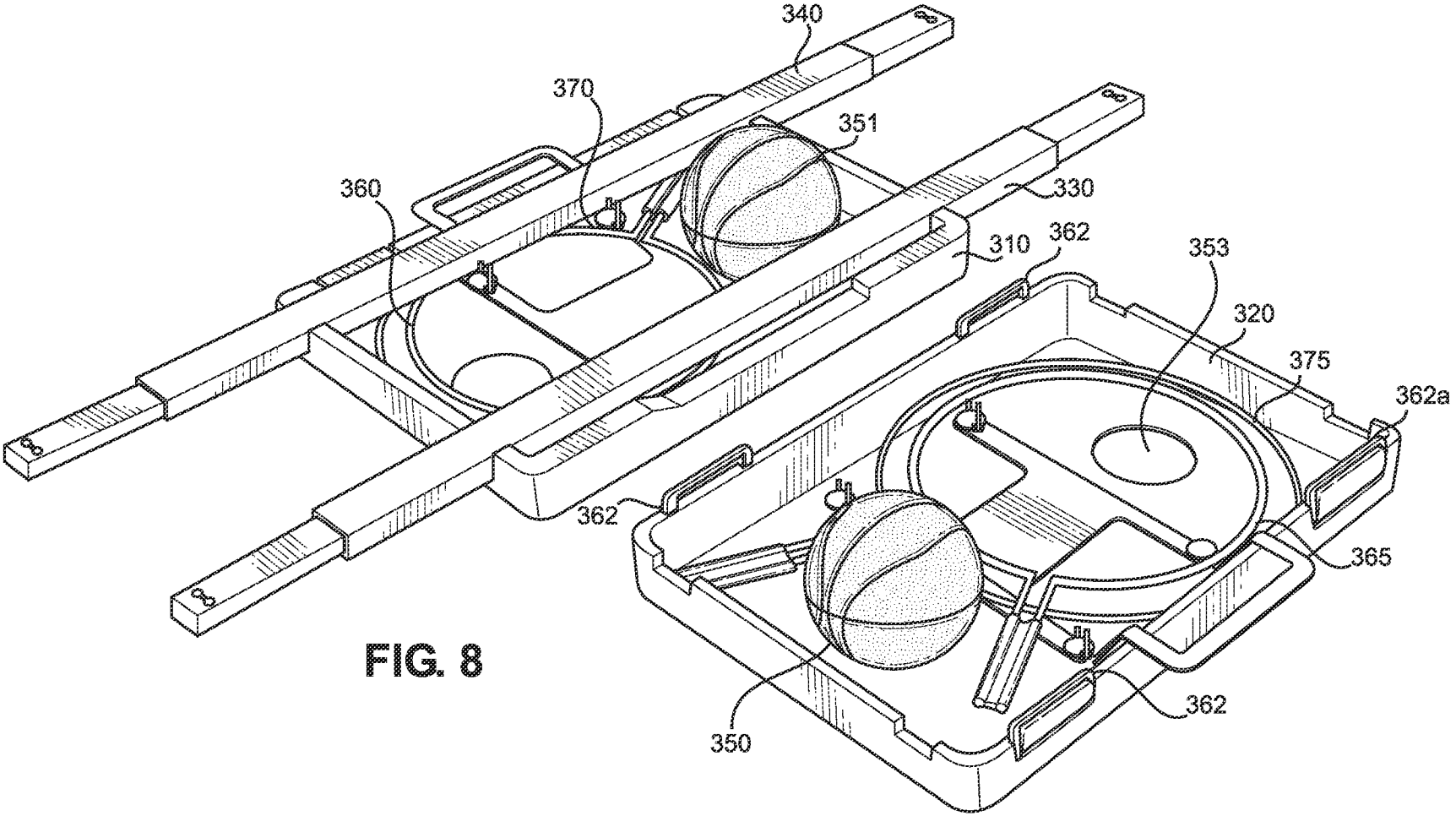
FIGS. 8-9 illustrate an alternative embodiment of the portable game apparatus according to the exemplary embodiments of the present disclosure.
Figure 9:
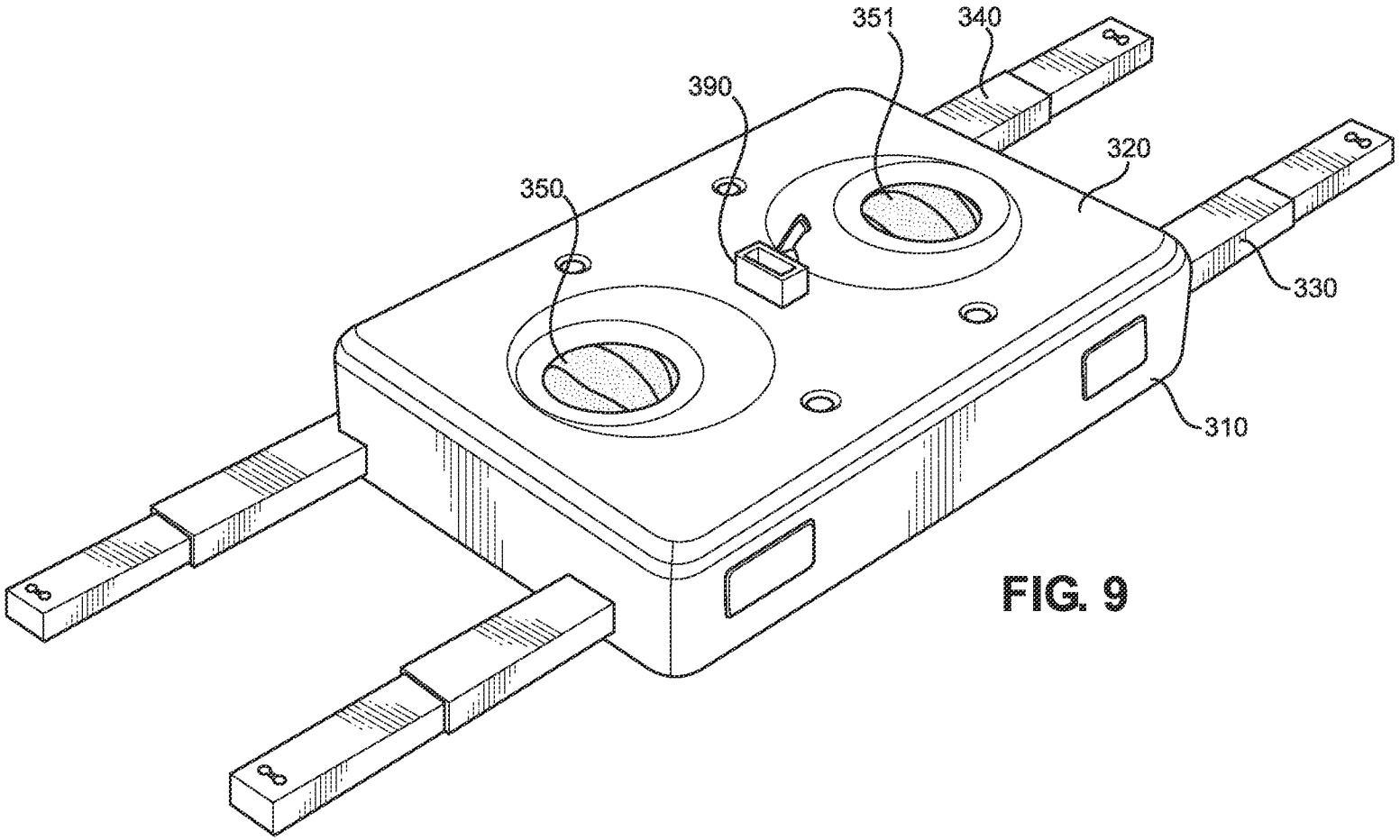

FIG. 8 illustrates an alternative embodiment of the portable game apparatus according to the exemplary embodiments of the present disclosure. For example, in this embodiment, an additional recess can be provided within the lower base portion to secure an additional ball 351. A corresponding recess 353 can be provided in the upper base portion so that the ball 351 is further secured within the upper base portion, as shown in FIG. 9 when the upper base portion 320 is provided over the lower base portion 310. In some exemplary embodiments, clamps 362 are provided on the upper base portion 320 at approximately the four corners of the upper base portion 320 that correspond to recesses in the side walls of the lower base portion 310 to secure the upper base portion 320 to the lower base portion 310. In some exemplary embodiments, the clamps 362 can be elastic bands or straps. In some exemplary embodiments, the cross-section of the upper pole 330 and lower pole 340 can be rectangular, as seen in FIGS. 8-9, as compared to square as shown in FIGS. 4-7. The cross-section of the upper and lower poles is not limited to any shape, and can be circular, square, rectangular or any other shape.

Figure 10:
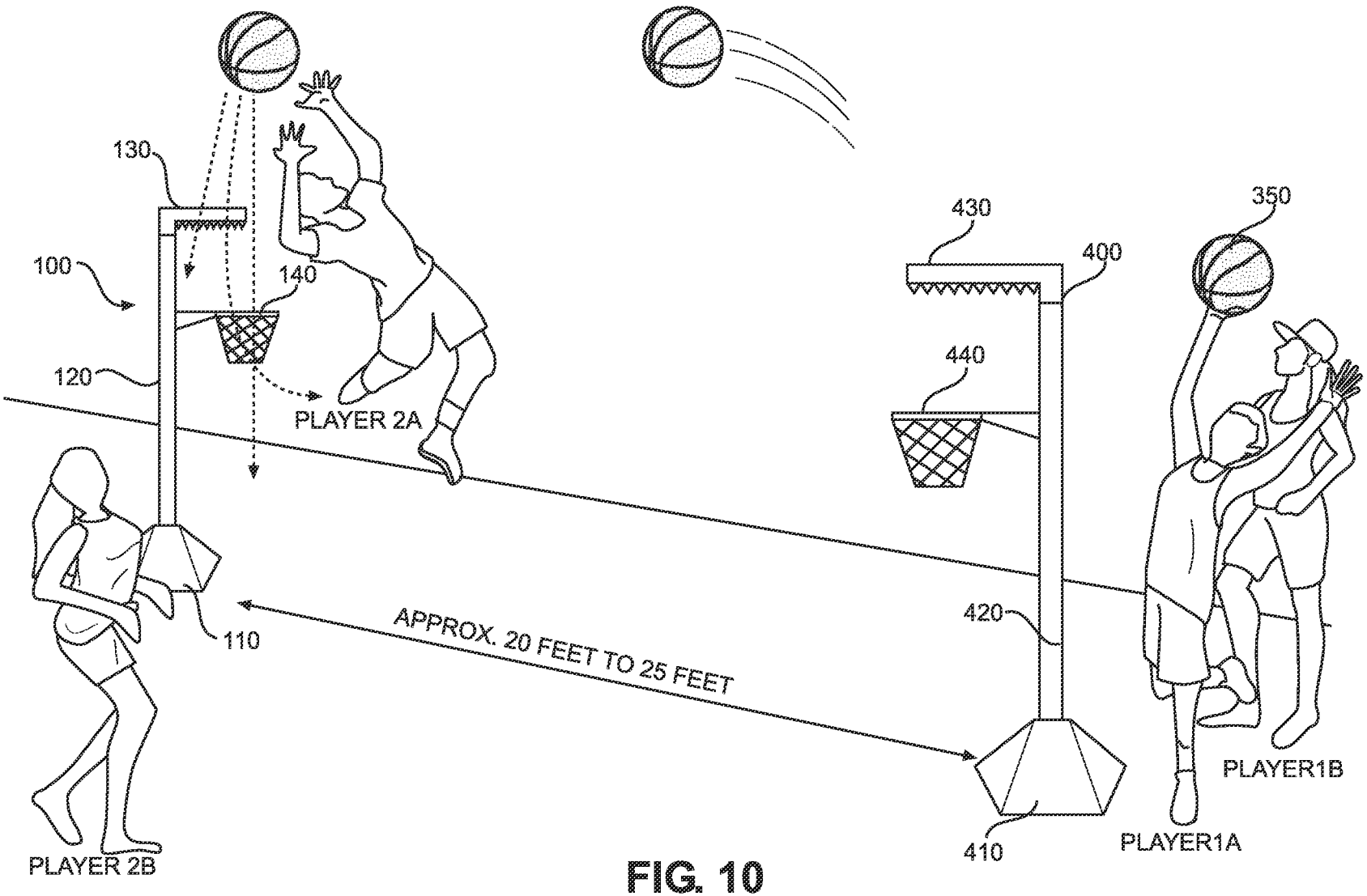
FIGS. 10-11 illustrate an exemplary embodiment of a method of playing a game according to the exemplary embodiments of the present disclosure.
Figure 11:
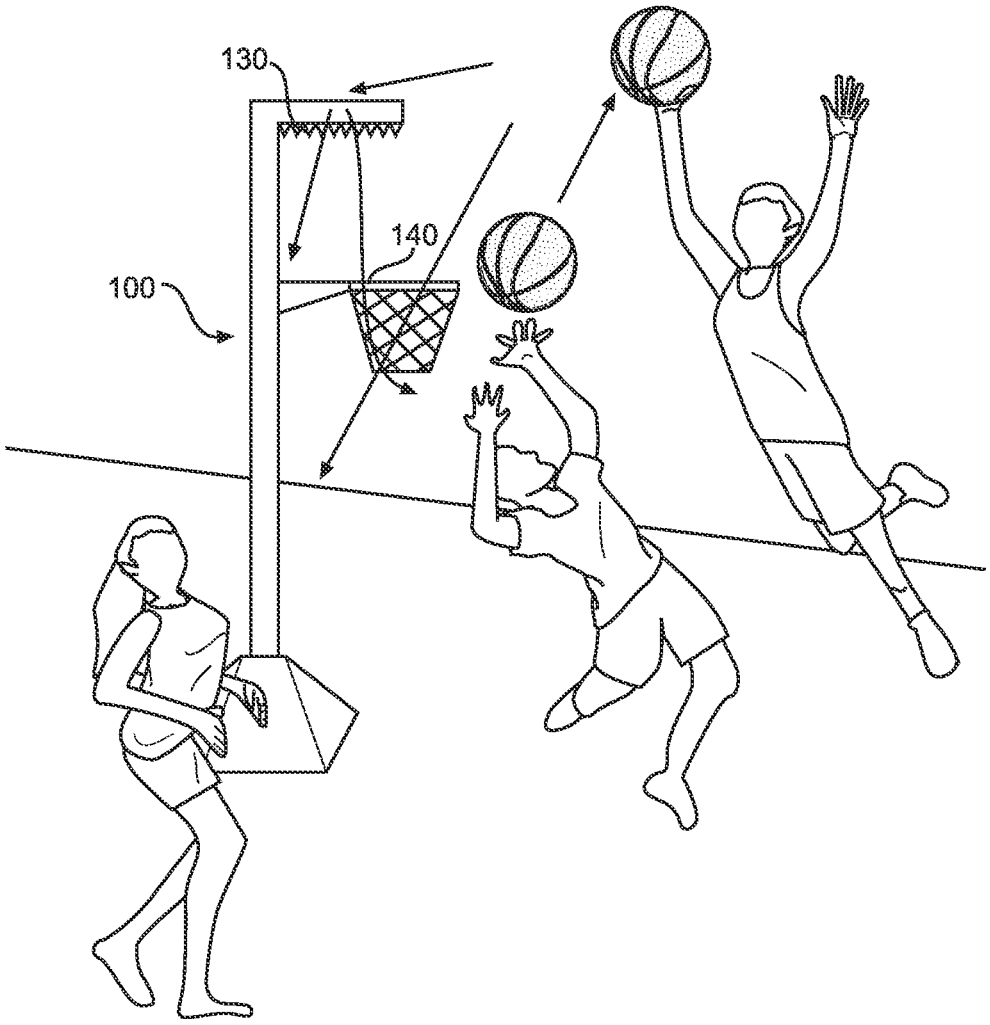
Figure 12A:
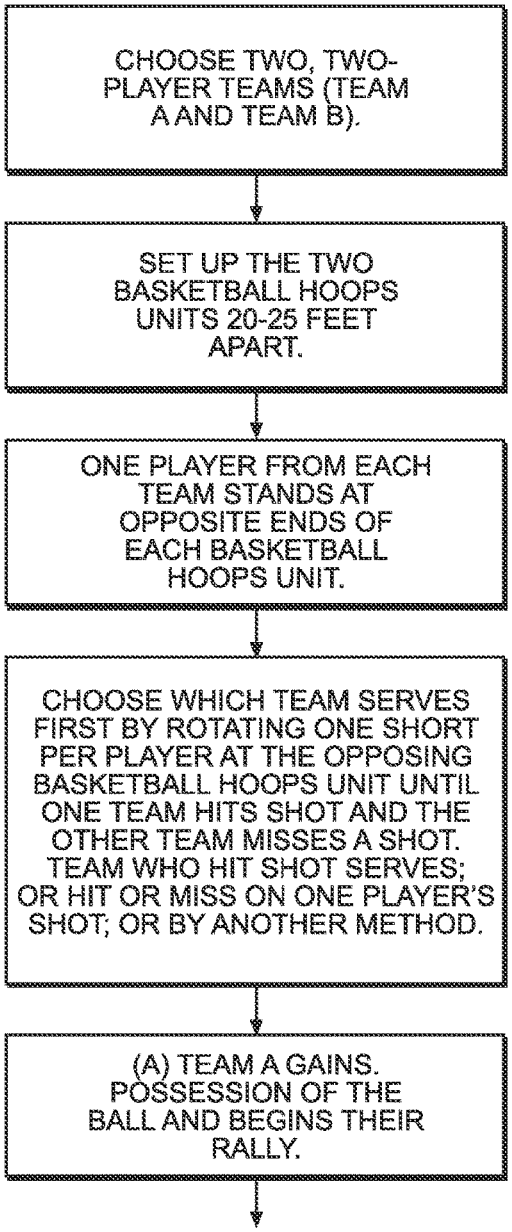
FIGS. 12(*a*)-12(*e*) illustrate a flowchart of a method of playing a game according to the exemplary embodiments of the present disclosure.
Figure 12B:
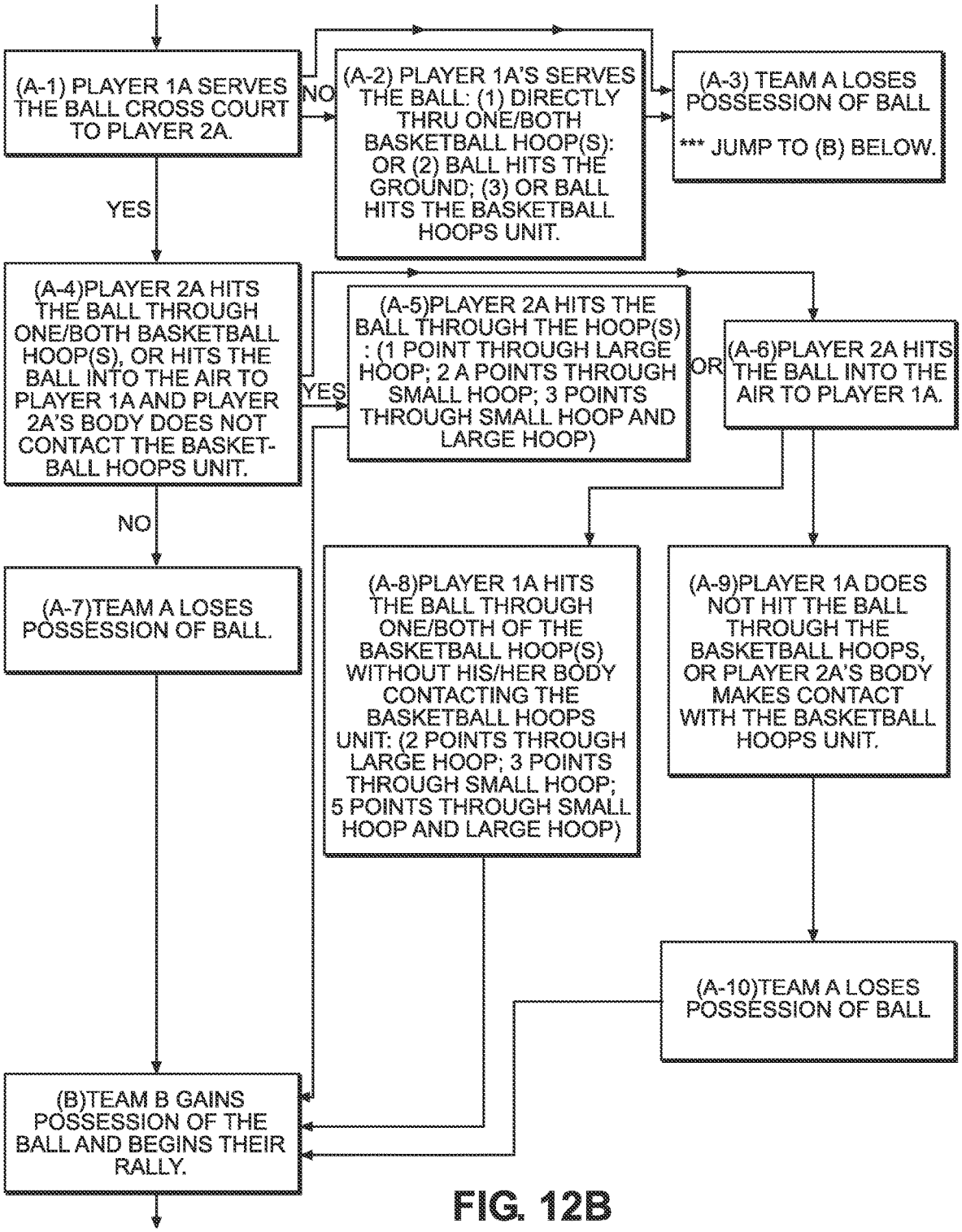
Figure 12C:
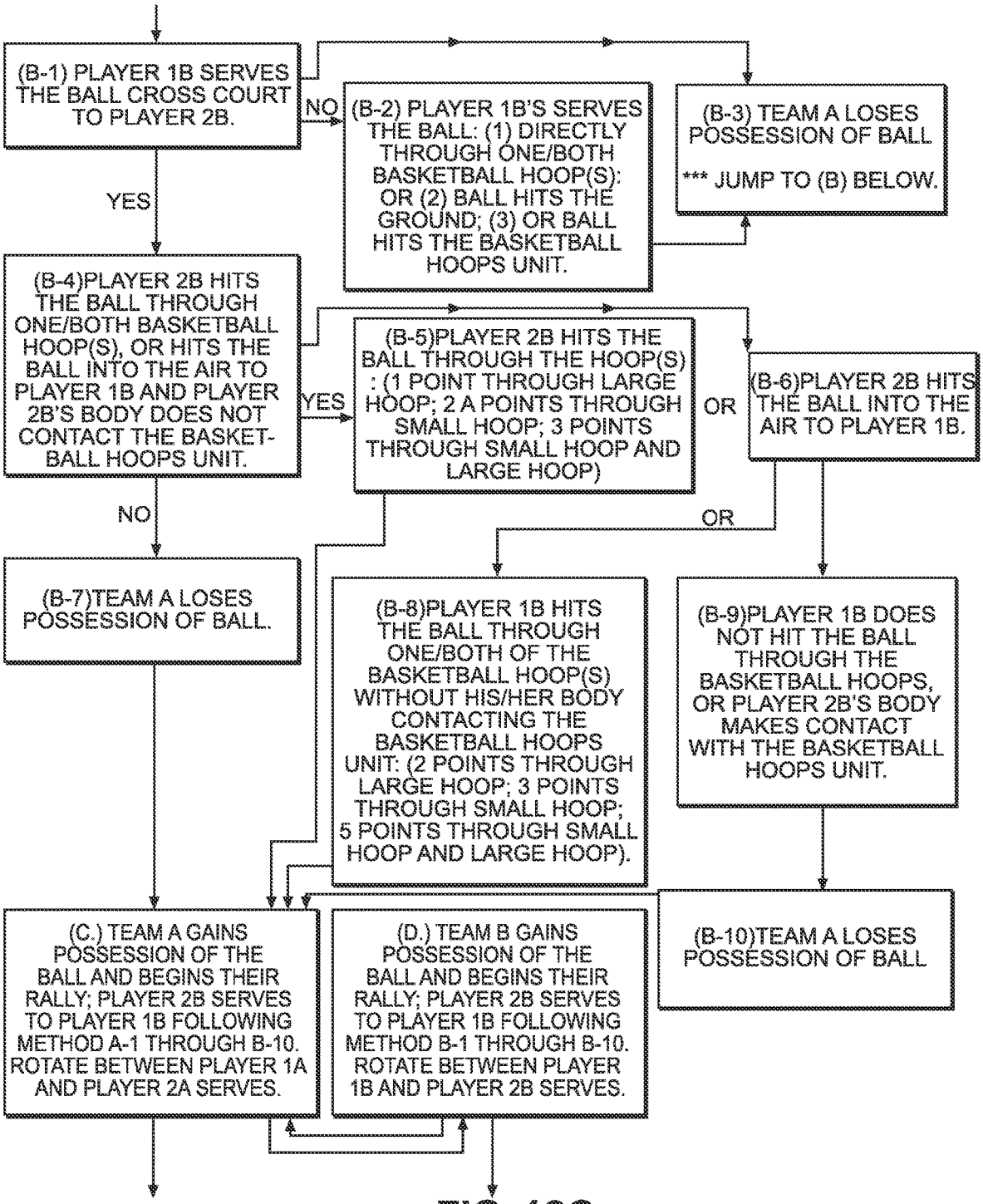
Figure 12D:
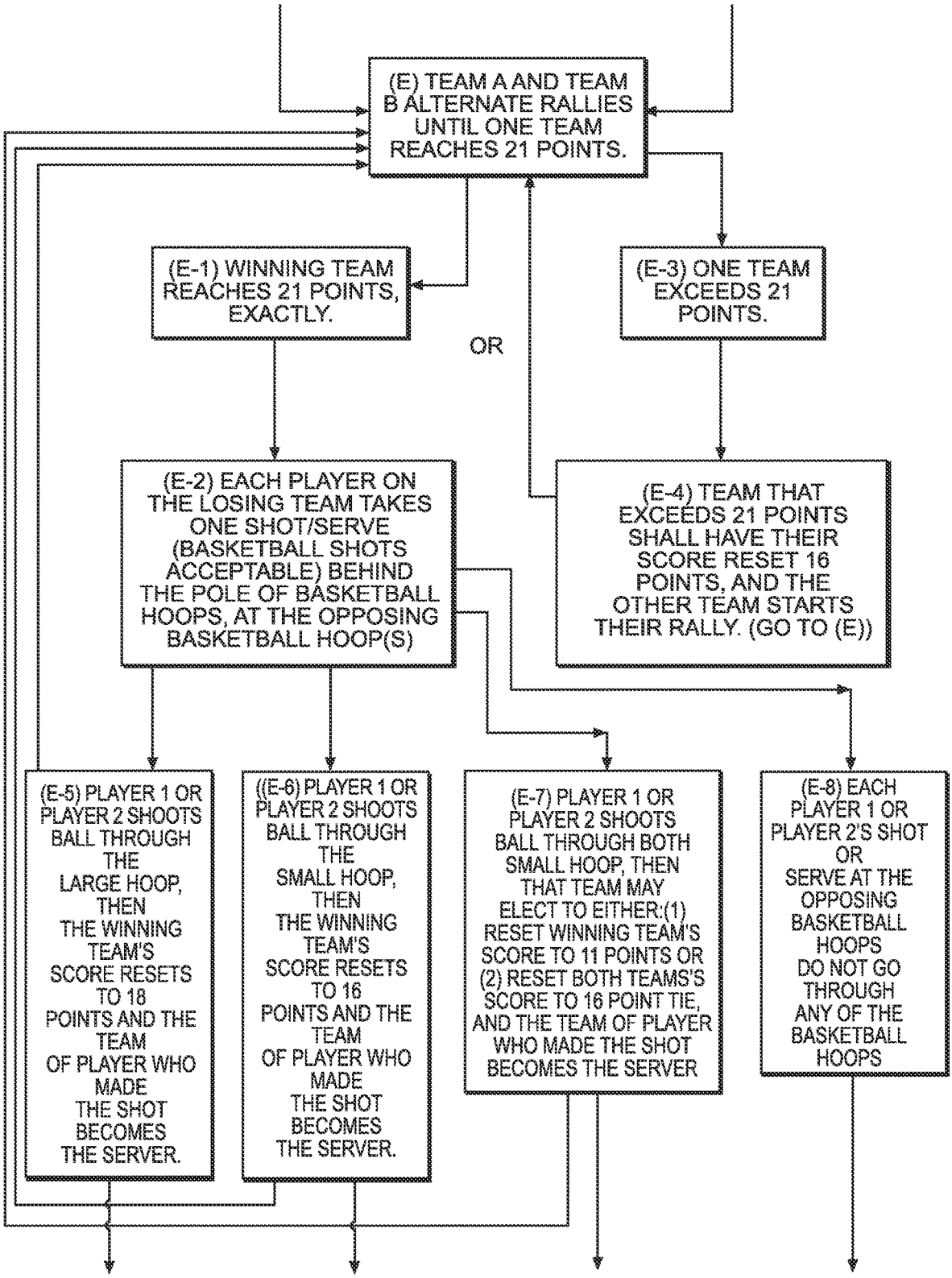
Figure 12E:
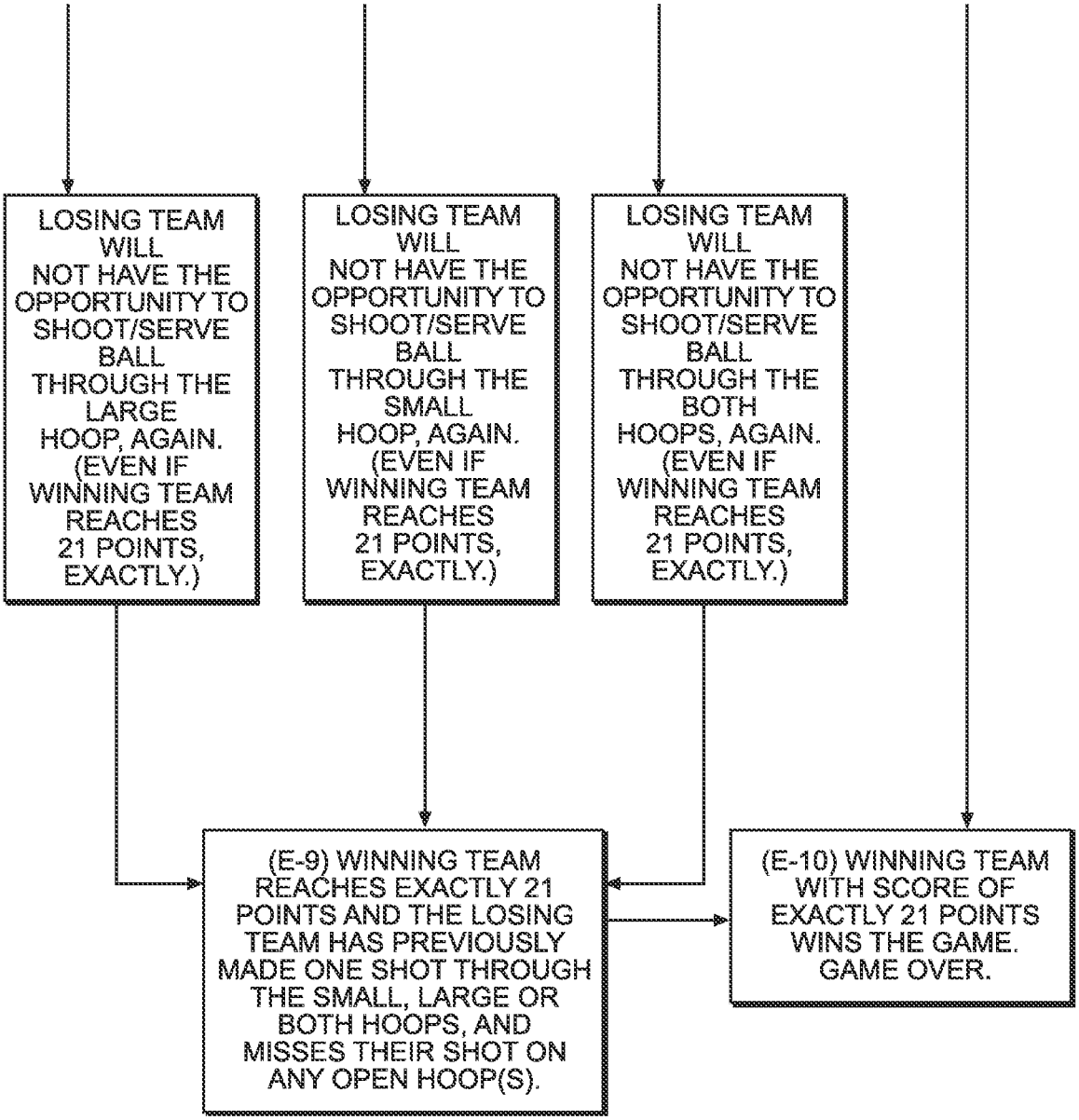

FIGS. 10-11 illustrate an exemplary embodiment of a method of playing a game according to the exemplary embodiments of the present disclosure. Initially, a first apparatus 100 is provided as shown in FIG. 10, and a second apparatus 400 is provided facing the first apparatus 100. In some exemplary embodiments, the first apparatus 100 is set up approximately 20 to approximately 30 feet away from the second apparatus 400. The second apparatus 200 can be similar to the first apparatus 100, shown in FIG. 7. For example, the first apparatus 100 can have a base 110, a pole 120, an upper hoop 130 and a lower hoop 140 approximately 2 feet under the upper hoop 130. In some exemplary embodiments, the lower hoop 140 is larger than and horizontally offset from the upper hoop 130 as described above. The second apparatus 400 can have a base 410, a pole 420, an upper hoop 430 and a lower hoop 440 approximately 2 feet under the upper hoop 430. In some exemplary embodiments, the lower hoop 440 is larger than and horizontally offset from the upper hoop 430 as described above.

All components of the portable apparatus in the exemplary embodiments of the present disclosure described above can be easily and quickly connected and disconnected from each other. Moreover, all components, when disconnected, are highly portable, can be made of lightweight and durable materials (such as but not limited to plastic or aluminum) and can be neatly stored in a bag, box, or in a storage area. It should further be noted that the exemplary embodiments are not limited to the particular methodology, materials, and modifications described and as such may, of course, vary. It is understood that the terminology used herein is for the purpose of describing particular aspects only, and is not intended to limit the scope of the present disclosure.

Exemplary rules according to the exemplary embodiments of the present disclosure can be but is not limited to the following. Two teams can be provided with two players on each team. Teammates can stand at opposing units (apparatus 100 and apparatus 400) at a diagonal direction from each other, and decide which team serves first with a "Shoot Off", as described below. The player serving the ball can be called the "server" and their teammate can be called the "setter." A "Shoot Off" can mean players on each team rotating one shot each at the opposing apparatus from behind the pole of the proximal apparatus. Once a player makes a shot, and an opposing player misses a shot, or a player has made a shot that cannot beat a player's shot on the opposite team, the player who made the shot becomes the server. A shot made through the upper (or smaller) hoop can beat a shot through the lower (or larger) hoop, while a shot through both the upper hoop and the lower hoop beats a shot made through only the upper hoop or only the lower hoop. Teams may elect to choose who serves first by another method, such as one player choosing hit or miss or a team choosing to flip a coin.

Game play can be as follows. Each team gets a separate chance—that is, when team 1 has a turn, team 2 must wait, and vice versa. The server must stand behind a pole of one apparatus and the setter must stand behind the pole of the opposing apparatus when the server is serving the ball. Once the ball is served by the server, the server and setter are allowed to move anywhere on the court. The server serves the ball to the setter close to the opposing apparatus, and the setter may elect to tap the ball directly into one or both of the upper and lower hoops, or the setter may elect to set the ball in the air to the server who may tap the ball into one or both of the upper and lower hoops. Various points can be assigned to the scoring, as described below. When the first team's turn ends, the second team has their own server and setter, and they can take their turn. The teams can alternate turns and play until one team reaches exactly 21 points, or another designated point total. Once one team reaches exactly 21 points, or another designated point total, each player on the opposing team may have one rebuttal shot as described below. Once one team reaches exactly 21 points, or another designated point total, and the opposing team has missed, or has closed out (see below), their rebuttal shot(s), the game can be over.

A point system in the game can be as follows. The setter can score by tapping the ball through the larger or lower hoop for 1 point, or another set number of points, or can taps the ball through the upper or smaller hoop for 2 points, or another set number of points, or can tap the ball through the upper smaller hoop and lower larger hoop for 3 points, or another set number of points. If the setter taps the ball back to the server and the server scores, the server can tap the ball through the lower or larger hoop for 2 points, or another set number of points, or the server can tap the ball through the upper or smaller hoop for 3 points, or another set number of points, or the server can tap the ball through the upper smaller hoop and the lower larger hoop for 5 points, or another set number of points.

For a team to win, the team can be required to score exactly 21 points, or another set number of points. If a team's score exceeds 21 points, their score can reset to 16 points, or another set number of points and the game can continue with the last setter on the opposing team becoming the server. In some exemplary embodiments, a rebuttal shot can be provided. Once one team reaches exactly 21 points, or another set number of points, both teams' turns can end, with the opposing team having a chance to continue the game with one or more rebuttal shots. Each player on the opposing team can have one rebuttal shot starting from behind his or her pole (e.g, a basketball type of shot). If a player makes a shot through the smaller or larger hoop, the winning team's score can reset from 21 points to 18 points, or another set number of points, and the game can continue with the player who made the shot becoming the server. If the opposing player makes a shot through the larger or smaller hoop the winning team's score can reset to 16 points, or another set number of points, and the game can continue with player who made the shot becoming the server. If the opposing player makes a shot that goes through the upper or smaller hoop and the lower or larger hoop, his or her team may elect to either: (1) reset the winning team's score to 11 points, or another set number of points, and the game continues with player who made the shot becoming the server; or (2) both teams' scores reset to a 16 point tie, or another set number of points, and the player who made the shot becomes the server.

In some exemplary embodiments of the present disclosure, rules are provided in which any violation of the rules can result in a foul. For example, if any of the following fouls occur, the team who commits the foul forfeits their team's turn with no points awarded (or one or more points can be subtracted): (1) server may not serve the ball directly through either hoop; (2) in total there may not be more than 3 hits, including the server, during each team's turn—the setter must be first to touch the ball off the serve, and players may not make contact with any part of either hoop; (3) a ball that hits any part of either hoop, and does not go through either hoop, can be a dead ball; (4) a ball that hits the ground, an opposing player, or another person or object can be a dead ball; (5) a player may not hit the ball consecutively; and (6) a player may not palm, cuff, carry, throw, toss, or catch the ball during his or her team's turn.

In some exemplary embodiments of the present disclosure, a defensive opportunity in the game can be as follows. Each team may be allowed 3 defensive opportunities per game. A team may use a defensive opportunity when either player (defensive player) from an opposing team (not in possession of the ball) crosses the pole of one apparatus, or another defense line designated to teams, any time after the server has served the ball from that apparatus. A defensive opportunity may allow the defensive player to chase down the server and alter the opposing team's set or shot, or block the ball before it goes through either hoop. The defensive player may not make contact with an opposing player or the apparatus, while trying to alter the shot or set, or block the ball before the ball goes through either hoop. If a defensive player makes contact with either offensive player or the apparatus, and that contact is determined to unfairly alter the offensive player(s) shot or set, the offensive team may be given foul shot(s) as set forth below.

In some exemplary embodiments of the present disclosure, a foul shot in the game can be as follows. If a defensive player makes contact with an opposing player or the apparatus, and the ball does not go through any hoops, each opposing player will be given one (1) shot per player (e.g., 2 shots per team) from behind each pole of an apparatus to the opposing apparatus for a chance to add to the team's score. A player may add 2 points, or another set number of points, to his or her team's score for a foul shot made through a lower or larger hoop. A player may add 3 points, or another set number of points, to his or her team's score for a foul shot made through the upper or smaller hoop. A player may add 5 points, or another set number of points, to his or her team's score for a foul shot made through the upper or smaller hoop and lower or larger hoop. If a defensive player makes contact with an opposing player or the apparatus, and the ball goes through any hoop(s), the points for the score will be added to the offensive team's score, and the offensive team will designate either player from the team to shoot 1 shot per team from behind either apparatus pole for a chance to add points, as described above.

As shown in FIG. 10, and described in the flowcharts provided in FIGS. 12(*a*)-12(*e*), players 1A and 2A can be on Team A, and players 1B and 2B can be on Team B. Player 1A can start behind the pole 420 of apparatus 400, and player 2A can start behind the pole 120 of apparatus 100. The apparatus 100 can be approximately 20 to approximately 30 feet away from the apparatus 400, and can be moved further or closer depending on the players' skill level. Player 1A can be the server, and player 2A can be the setter. To start, player 1A can serve the ball 350. The ball 350 can be but is not limited to a spherical ball similar to a volleyball, can have but is not limited to a diameter of approximately 4 inches to approximately 10 inches and a weight of approximately 4 ounces to approximately 10 ounces. Player 1A should not serve the ball 350 directly through either hoop 130 or 140. Once the ball 350 is served by the setter player 1A, player 1A and player 2A can move anywhere. While Team A takes their turn, players on Team B (players 1B and 2B) can position themselves anywhere to not interfere with Team A.

When player 1A serves 350 the ball 22 to player 2A, player 2A may elect to tap the ball 350 directly into the lower hoop 140, upper hoop 130, or the upper hoop 130 and lower hoop 140 as described above for a predetermined amount of points. If player 2A taps the ball 350 and the ball hits any component of the apparatus 100 and does not go through any of the hoops or hits the ground, or another object, Team A should not score any points, and Team B can have their turn. In some exemplary embodiments, as shown in FIG. 11, player 2A can hit the ball 350 back to player 1A after player 1A serves the ball 350 to player 2A. Player 2A may elect to set the ball 350 in the air to player 1A who may tap the ball 350 through the lower hoop 140, the upper hoop 130, or the upper hoop 130 and the lower hoop 140, for the points as described above. If Player 1A taps the ball 350 and the ball 350 hits any component of the apparatus 100 and does not go through any of the hoops or hits the ground, or another object, Team A does not score any points. When Team A's turn is over, Team B takes their turn, and player 2B can be the server and player 1B can be the setter and attempt to score points on apparatus 400 similar to how Team A attempts to score on apparatus 100. The two teams alternate turns and as server/setter, so after Team B's turn is over, and it is Team A's turn again, player 2A can go behind apparatus 400 and be the server, and player 1A can be the setter and go behind apparatus 400. The teams can continue turns until one team reaches exactly 21 points, or another set number of points.

The apparatus according to the exemplary embodiments of the present disclosure can have various shapes and configurations, and is not limited to any particular shape or configuration. Various materials can be used for the construction of the apparatus 100 and its components. Various components can be provided together, or individually.

Various advantages are provided for the portable game apparatus as described above, and various configurations are also possible according to the exemplary embodiments of the present disclosure. For example, although the embodiments described above have two poles, more than two poles can be provided that telescope within each other to provide an appropriate height for the pole. More than two hoops can be provided on each pole. A hoop may attach to the crown of the top pole, while other hoops (smaller or larger) can be attached to the middle and/or lower parts of the pole. A backboard may be provided behind the poles and/or behind each hoop provided on the pole. A spike, stake or string may be added to help support the base, pole, and the hoops.

A backpack or bag may be designed for portability to carry components of the portable apparatus when disassembled. Also, the design of the backpack or bag may act as the base unit, so the pole(s), when upright, can slide into the base for support. Moreover, all components of the hoops device, including the pole(s), hoops, nets, and ball(s) may have a designated area in the base backpack, where each component may fasten or affix to the base backpack for easy portability and setup. Furthermore, two or more base backpacks may snap together or attach to each other with straps or affix another way. One or both base backpacks may have handles, grips and/or shoulder straps. The design of the ball may have half its seams designed similar to a basketball pattern and the other half of the seams may be designed similar to a volleyball pattern. Moreover, there may be a miniature version of the portable apparatus, or a portable apparatus designed to float in water, or a portable apparatus designed to attach or stand on a table. The portable apparatus can be used on multiple surfaces such as asphalt, grass, indoor courts, or sand.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements, manufacture and methods which, although not explicitly shown or described herein, embody the principles of the disclosure and are thus within the spirit and scope of the disclosure.

What is claimed is:

1. A method of playing a game, comprising:

providing a first portable apparatus at a first location, the first portable apparatus comprising a first pole extending vertically from a base portion and having an upper hoop and a lower hoop connected to the first pole, the lower hoop being provided under the upper hoop;

providing a second portable apparatus at a second location opposite the first location, the second portable apparatus comprising a second pole extending vertically from a base portion and having an upper hoop and a lower hoop connected to the second pole, the lower hoop being provided under the upper hoop;

selecting a first team and a second team, each team having a first player adjacent the first portable apparatus and a second player adjacent the second portable apparatus;

wherein a first player of the first team adjacent the first portable apparatus stands behind the base portion of the first portable apparatus and serves a ball to the second player of the first team adjacent the second portable apparatus;

wherein the second player of the first team receives the ball and can:

i) score the ball through the lower hoop of the second portable apparatus for a set number of points;

ii) score the ball through the upper hoop of the second portable apparatus for a set number of points greater than the set number of points of (i);

iii) score the ball through the upper hoop and lower hoop of the second portable apparatus for a set number of points greater than (ii); or iv) hit the ball back to the first player of the first team.

2. The method according to claim 1, wherein the upper hoops and the lower hoops of the first and second poles are circular hoops, and the upper hoops have a smaller diameter than the lower hoops.

3. The method according to claim 2, wherein the lower hoops of the first and second poles are horizontally offset from the upper hoops of the first and second poles, respectively, and an outermost portion of the lower hoops extends further from the first and second poles than an outermost portion of the upper hoops of the first and second poles, respectively.

4. The method according to claim 2, wherein the upper hoops of the first and second poles have a diameter of approximately 8 inches to approximately 16 inches, and the lower hoops of the first and second poles have a diameter of approximately 10 inches to approximately 20 inches.

5. The method according to claim 2, wherein the upper hoops and the lower hoops are adjustable along a height of the first pole and the second pole.

6. The method according to claim 1, wherein the lower hoops are provided approximately two feet under the upper hoops of the first and second poles.

7. The method according to claim 1, further comprising:

awarding a set number of points if the second player of the first team hits the ball back to the first player of the first team and the first player of the first team scores the ball through the upper hoop or lower hoop of the second portable apparatus.

8. The method according to claim 1, wherein the first player or second player of the first team may not directly contact the upper or lower hoops of the second portable apparatus.

9. The method according to claim 8, wherein a set number of points are deducted from the first team if the first player or second player of the first team makes direct contact with the upper hoop or lower hoop of the second portable apparatus.

10. The method according to claim 1, wherein the first portable apparatus is provided approximately 20 to approximately 30 feet away from the second portable apparatus.

11. The method according to claim 1, wherein when the first player of the first team serves the ball to the second player of the first team, the ball must be served directly to the second player of the first team without making contact with the ground or any other object, or the first team loses possession and the ball is given to the second team.

12. A method of playing a game, comprising:

providing a first pole having a first hoop and a second hoop under the first hoop on the first pole;

providing a second pole opposite the first pole, the second pole having a first hoop and a second hoop under the first hoop on the second pole;

selecting a first team having a first player adjacent the first pole and a second player adjacent the second pole;

selecting a second team having a first player adjacent the first pole and a second player adjacent the second pole;

wherein the first player of the first team stands behind the first pole and serves the ball directly to the second player of the first team adjacent the second pole;

providing a method of scoring wherein:

(i) awarding one or more points to the first team if the second player scores the ball in the second hoop of the second pole;

(ii) awarding two or more points to the first team if the second player scores the ball in the first hoop of the second pole; and (iii) awarding three or more points to the first team if the second player scores the ball in the first hoop and the second hoop of the second pole.

13. The method according to claim 12, further comprising:

providing a method of scoring when the first player of the first team serves the ball directly to the second player of the first team, the second player of the first team hits the ball back to the first player of the first team, wherein:

(i) awarding one or more points to the first team if the first player scores the ball in the second hoop of the second pole;

(ii) awarding two or more points to the first team if the first player scores the ball in the first hoop of the second pole; and (iii) awarding three or more points to the first team if the first player scores the ball in the first hoop and the second hoop of the second pole.

14. The method according to claim 13, wherein the first player or second player of the first team may not directly contact the first hoop or second hoop of the second pole.

15. The method according to claim 14, wherein a point is deducted from the first team if the first player or second player of the first team makes direct contact with the first hoop or second hoop of the second pole and the ball is given to the second team for their turn.

16. The method according to claim 15, wherein when the second team gets the ball:

the second player of the second team stands behind the second pole and serves the ball directly to the first player of the second team adjacent the first pole;

providing a method of scoring wherein:

(i) awarding one or more points to the second team if the first player of the second team scores the ball in the second hoop of the first pole;

(ii) awarding two or more points to the second team if the first player of the second team scores the ball in the first hoop of the first pole; and (iii) awarding three or more points to the second team if the first player of the second team scores the ball in the first hoop and the second hoop of the first pole.

17. The method according to claim 12, further comprising:

providing a method of scoring when the second player of the second team serves the ball directly to the first player of the second team, the first player of the second team hits the ball back to the second player of the second team, wherein:

(i) awarding one or more points to the second team if the second player of the second team scores the ball in the second hoop of the first pole;

(ii) awarding two or more points to the second team if the second player of the second team scores the ball in the first hoop of the first pole; and (iii) awarding three or more points to the second team if the second player of the second team scores the ball in the first hoop and the second hoop of the first pole.

18. The method according to claim 12, wherein the first pole is provided approximately 20 to approximately 30 feet away from the second pole.

19. The method according to claim 12, wherein the first hoops and the second hoops of the first and second poles are circular hoops, and the first hoops have a smaller diameter than the second hoops.

20. The method according to claim 19, wherein the second hoops of the first and second poles are horizontally offset from the first hoops of the first and second poles, respectively, and an outermost portion of the second hoops extends further from the first and second poles than an outermost portion of the first hoops of the first and second poles, respectively.

* * * * *